US008857334B2

(12) United States Patent
Cho et al.

(10) Patent No.: US 8,857,334 B2
(45) Date of Patent: Oct. 14, 2014

(54) CLEANING APPARATUSES FOR PRINTING PLATES AND PRINTING APPARATUSES INCLUDING THE SAME

(75) Inventors: Jung-Woo Cho, Hwaseong-si (KR); Sin Kwon, Suwon-si (KR); Min-Uk Kim, Seongnam-si (KR); Hyun-Seok Kim, Anyang-si (KR); Nam Hoon Lee, Anyang-si (KR); Sung Gun Lee, Seongnam-si (KR); Sung Hee Lee, Seoul (KR); Jae Hyuk Chang, Seongnam-si (KR)

(73) Assignee: Samsung Electronics Co., Ltd (KR)

( * ) Notice: Subject to any disclaimer, the term of this patent is extended or adjusted under 35 U.S.C. 154(b) by 103 days.

(21) Appl. No.: 13/547,481

(22) Filed: Jul. 12, 2012

(65) Prior Publication Data

US 2013/0228087 A1 Sep. 5, 2013

(30) Foreign Application Priority Data

Mar. 5, 2012 (KR) ..... 10-2012-0022389

(51) Int. Cl.
*B41F 35/00* (2006.01)

(52) U.S. Cl.
USPC ..... 101/425; 101/423

(58) Field of Classification Search
USPC ..... 101/425
See application file for complete search history.

(56) References Cited

U.S. PATENT DOCUMENTS 5,163,235 A * 11/1992 Hoffmann et al. ..... 34/60
5,603,775 A * 2/1997 Sjoberg ..... 134/21
6,364,449 B1 * 4/2002 Takahashi et al. ..... 347/30
6,957,607 B2 * 10/2005 Biagiotti ..... 101/424
7,658,147 B2 2/2010 Chung et al.
7,770,516 B2 8/2010 Jeong
8,567,314 B2 * 10/2013 Tanaka et al. ..... 101/425
2005/0122371 A1 * 6/2005 Aliaga ..... 347/22
2005/0132913 A1 6/2005 Gottling et al.
2006/0266242 A1 * 11/2006 Bartesaghi et al. ..... 101/425
2007/0175348 A1 * 8/2007 Petri ..... 101/424
2007/0277930 A1 * 12/2007 Yokoyama et al. ..... 156/345.31
2008/0000374 A1 1/2008 Kim et al.
2010/0307358 A1 * 12/2010 Sakaue et al. ..... 101/425
2011/0185932 A1 8/2011 Funahata
2012/0125215 A1 5/2012 Cho et al.

FOREIGN PATENT DOCUMENTS

JP 2001-328244 A 11/2001
JP 2006-256197 A 9/2006
JP 2010-143101 A 7/2010

(Continued)

*Primary Examiner* — Anthony Nguyen
(74) *Attorney, Agent, or Firm* — Harness, Dickey & Pierce PLC

(57) ABSTRACT

A printing plate cleaning apparatus may include a cleaning chamber configured to receive a printing plate to be cleaned, a nozzle supporter in the cleaning chamber, and/or a unified nozzle unit that includes a cleaning nozzle unit and a rinsing nozzle unit unified as a body and attached to the nozzle supporter. The cleaning nozzle unit may include a cleaner nozzle configured to inject cleaner to the printing plate and/or a first suction nozzle suctioning waste. The rinsing nozzle unit may include a rinsing liquid nozzle configured to inject rinsing liquid to the printing plate and/or a second suction nozzle suctioning the waste. A printing plate cleaning apparatus may include the cleaning chamber, a cleaning nozzle unit in the cleaning chamber, and/or a rinsing nozzle unit in the cleaning chamber. The cleaning and rinsing nozzle units may be configured to move together with each other in the cleaning chamber.

8 Claims, 12 Drawing Sheets

(56) References Cited

FOREIGN PATENT DOCUMENTS

| | | | |
|---|---|---|---|
| JP | 2011-161906 | A | 8/2011 |
| KR | 10-2007-0120389 | A | 12/2007 |
| KR | 10-2009-0003883 | A | 1/2009 |
| KR | 10-2009-0131207 | A | 12/2009 |
| KR | 10-2010-0054458 | A | 5/2010 |
| KR | 10-2010-0078255 | A | 7/2010 |
| KR | 10-1016844 | B1 | 2/2011 |
| KR | 10-2011-0070359 | A | 6/2011 |

* cited by examiner

CLEANING APPARATUSES FOR PRINTING PLATES AND PRINTING APPARATUSES INCLUDING THE SAME

CROSS-REFERENCE TO RELATED APPLICATION(S)

This application claims priority from Korean Patent Application No. 10-2012-0022389, filed on Mar. 5, 2012, in the Korean Intellectual Property Office (KIPO), the entire contents of which are incorporated herein by reference.

BACKGROUND

1. Field

Example embodiments relate to printing plate cleaning apparatuses and/or printing apparatuses including the same.

2. Description of Related Art

Electronic printing as a next generation printing technology that is an alternative to remarkably improve a conventional production technology such as for a semiconductor and a display device is a technology for printing a pattern of various electronic elements such as a sensor, a solar battery, a flat panel display, an electronic circuit, etc.

The electronic printing technology simplifies a manufacturing process of the several electronic elements compared with a conventional photolithography process such that manufacturing time and production cost may be remarkably reduced and mass production is possible because of a low manufacturing cost. Also, the electronic printing technology may be applied to a substrate of various materials such as plastic, fiber, and paper as well as a glass substrate such that a usage range thereof is very wide.

Examples of the electronic printing technology include inkjet printing, nanoimprinting, gravure printing, reverse offset printing, offset print printing, and microcontact printing. Among them, the reverse offset printing may use an ink having low viscosity, and is advantageous in an aspect of thickness uniformity of the ink such that it may be variously applied to the manufacturing of a thin film transistor, a color filter, etc.

In the various electronic printing technologies, a printing plate for forming a transferred ink pattern is used, and the printing plate is referred to as a cliche in the reverse offset print. This printing plate may include a concave or convex pattern, and it is necessary to clean ink or foreign particles that may remain on the printing plate after the printing process. In the cleaning process of the printing plate, if the printing plate is not thoroughly cleaned, a printing defect may be generated by the remaining foreign particles in a next printing process such that the thorough cleaning of the printing plate is important to increase printing quality.

The above information disclosed in this Background section is only for enhancement of understanding of the background of the invention and therefore it may contain information that does not form the prior art that is already known in this country to a person of ordinary skill in the art.

SUMMARY

Example embodiments may provide cleaning apparatuses and/or printing apparatuses including the same for thoroughly cleaning printing plates used in printing processes.

In some example embodiments, a printing plate cleaning apparatus may include a cleaning chamber configured to receive a printing plate to be cleaned, a nozzle supporter in the cleaning chamber, and/or a unified nozzle unit that includes a cleaning nozzle unit and a rinsing nozzle unit unified as a body and attached to the nozzle supporter. The cleaning nozzle unit may include a cleaner nozzle configured to inject cleaner to the printing plate and a first suction nozzle suctioning waste. The rinsing nozzle unit may include a rinsing liquid nozzle configured to inject rinsing liquid to the printing plate and a second suction nozzle suctioning the waste.

In some example embodiments, the printing plate cleaning apparatus may further include at least one air knife attached to an outer surface of the unified nozzle unit.

In some example embodiments, at least one of an injecting angle of the at least one air knife and a height of the at least one air knife with regard to the printing plate may be adjustable.

In some example embodiments, the printing plate cleaning apparatus may further include a nozzle wiping apparatus configured to clean a nozzle of the unified nozzle unit.

In some example embodiments, the nozzle wiping apparatus may include a first wiper on a lower portion of the cleaning chamber.

In some example embodiments, the first wiper may be attachable to and detachable from the lower portion of the cleaning chamber.

In some example embodiments, the nozzle wiping apparatus may include a wiper roll that is movable under the nozzle of the unified nozzle unit.

In some example embodiments, the printing plate cleaning apparatus may further include a printing plate table to which the printing plate is attached and/or at least one suction bar attached to at least one outer surface of the printing plate table. The nozzle wiping apparatus may include a second wiper installed on an upper surface of the suction bar.

In some example embodiments, the at least one suction bar may include a suction slit suctioning the waste.

In some example embodiments, at least one of the cleaning nozzle unit and the rinsing nozzle unit may further include an air nozzle.

A printing apparatus may include a base plate; a printing device on the base plate, the printing device including a printing plate table; and/or a printing plate cleaning apparatus on the base plate. The printing plate cleaning apparatus may include a cleaning chamber configured to receive a printing plate that is on the printing plate table, a nozzle supporter in the cleaning chamber, and/or a unified nozzle unit that includes a cleaning nozzle unit and a rinsing nozzle unit unified as a body and attached to the nozzle supporter. The cleaning nozzle unit may include a cleaner nozzle configured to inject a cleaner to the printing plate and a first suction nozzle suctioning waste. The rinsing nozzle unit may include a rinsing liquid nozzle configured to inject a rinsing liquid to the printing plate and a second suction nozzle suctioning the waste.

In some example embodiments, the printing apparatus may further include at least one air knife attached to an outer surface of the unified nozzle unit.

In some example embodiments, at least one of an injecting angle of the at least one air knife and a height of the at least one air knife with respect to the printing plate may be adjustable.

In some example embodiments, the printing apparatus may further include a nozzle wiping apparatus configured to clean a nozzle of the unified nozzle unit.

In some example embodiments, the nozzle wiping apparatus may include a first wiper on a lower portion of the cleaning chamber.

In some example embodiments, a printing plate cleaning apparatus may include a cleaning chamber configured to receive a printing plate to be cleaned, a cleaning nozzle unit in the cleaning chamber, and/or a rinsing nozzle unit in the cleaning chamber. The cleaning nozzle unit may include a cleaner nozzle configured to inject cleaner to the printing plate and/or a first suction nozzle suctioning waste. The rinsing nozzle unit may include a rinsing liquid nozzle configured to inject rinsing liquid to the printing plate and/or a second suction nozzle suctioning the waste. The cleaning nozzle unit and the rinsing nozzle unit may be configured to move together with each other in the cleaning chamber.

In some example embodiments, the cleaning nozzle unit and the rinsing nozzle unit may be configured to move together with each other in the cleaning chamber so that a distance between the cleaning nozzle unit and the printing plate becomes larger or smaller.

In some example embodiments, the cleaning nozzle unit and the rinsing nozzle unit may be configured to move together with each other in the cleaning chamber so that a distance between the rinsing nozzle unit and the printing plate becomes larger or smaller.

In some example embodiments, the cleaning nozzle unit and the rinsing nozzle unit may be configured to move together with each other in the cleaning chamber in a direction substantially parallel to an upper surface of the printing plate.

In some example embodiments, the cleaning nozzle unit and the rinsing nozzle unit may be configured to rotate together with each other in the cleaning chamber.

BRIEF DESCRIPTION OF THE DRAWINGS

The above and/or other aspects and advantages will become more apparent and more readily appreciated from the following detailed description of example embodiments, taken in conjunction with the accompanying drawings, in which.

DETAILED DESCRIPTION

Figure 1:
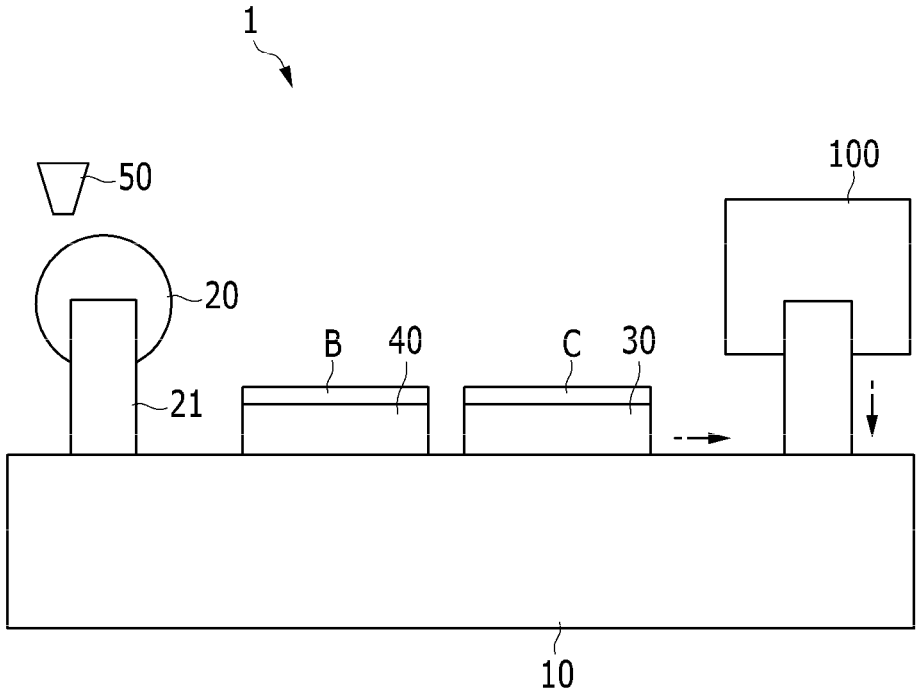
FIG. 1 is a schematic lateral view of a printing apparatus according to some example embodiments.

Example embodiments will now be described more fully with reference to the accompanying drawings. Embodiments, however, may be embodied in many different forms and should not be construed as being limited to the embodiments set forth herein. Rather, these example embodiments are provided so that this disclosure will be thorough and complete, and will fully convey the scope to those skilled in the art. In the drawings, the thicknesses of layers and regions may be exaggerated for clarity.

It will be understood that when an element is referred to as being yto the accompanying drawings. Embodiments, however, may be embodied in many different forms and shoulectly on, connected to, electrically connected to, or coupled to the other component or intervening components may be present. In contrast, when a component is referred to as being "directly on," "directly connected to," "directly electrically connected to," or "directly coupled to" another component, there are no intervening components present. As used herein, the term e understood that when an element is referred to as being yto the accompanying drelectri.

It will be understood that although the terms first, second, third, etc., may be used herein to describe various elements, components, regions, layers, and/or sections, these elements, components, regions, layers, and/or sections should not be limited by these terms. These terms are only used to distinguish one element, component, region, layer, and/or section from another element, component, region, layer, and/or section. For example, a first element, component, region, layer, and/or section could be termed a second element, component, region, layer, and/or section without departing from the teachings of example embodiments.

Spatially relative terms, such as h the terms first, second, third, etc., may be used herein to describe various elements, components, regions, layers, and/or sections, these elements and/or feature to another component and/or feature, or other component(s) and/or feature(s), as illustrated in the drawings. It will be understood that the spatially relative terms are intended to encompass different orientations of the device in use or operation in addition to the orientation depicted in the figures.

The terminology used herein is for the purpose of describing particular example embodiments only and is not intended to be limiting of example embodiments. As used herein, the singular forms ea,ure to another component and/or feature, or otherral forms as well, unless the context clearly indicates otherwise. It will be further understood that the terms ntended to be limiting of example embodiments. As used herein, the singular forms ea,ure to another component and/or feature, or other use or opteps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and should not be interpreted in an idealized or overly formal sense unless expressly so defined herein.

Reference will now be made to example embodiments, which are illustrated in the accompanying drawings, wherein like reference numerals may refer to like components throughout.

Firstly, a printing apparatus according to some example embodiments will be described with reference to FIG. 1 and FIG. 2.

Figure 2:
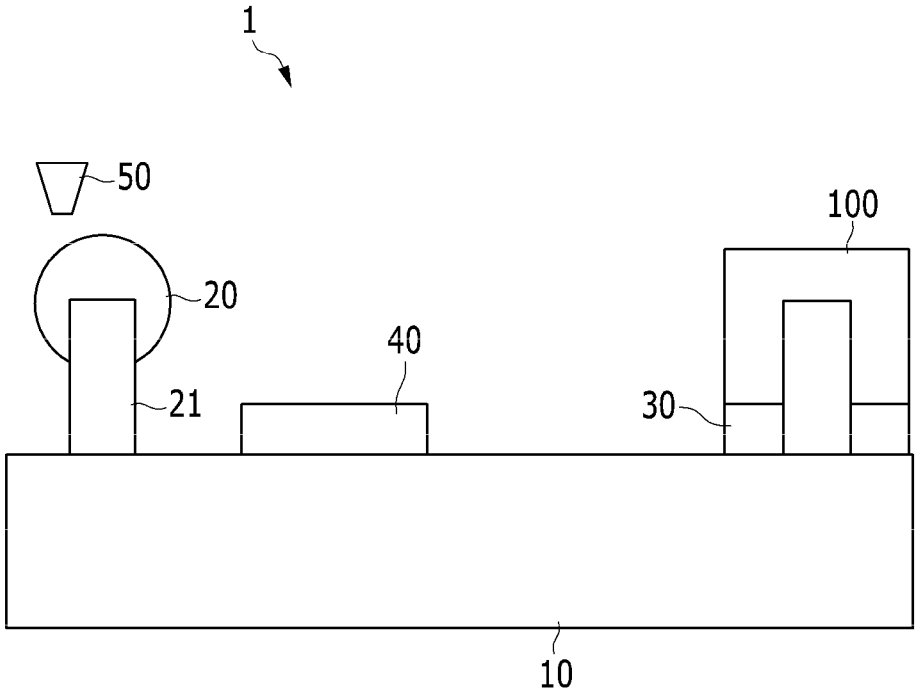
FIG. 2 is a schematic lateral view showing a state in which a printing plate table is moved to a cleaning apparatus in a printing apparatus according to some example embodiments.

FIG. 1 is a schematic lateral view of a printing apparatus according to some example embodiments, and FIG. 2 is a schematic lateral view showing a state in which a printing plate table is moved to a cleaning apparatus in a printing apparatus according to some example embodiments.

Referring to FIG. 1 and FIG. 2, a printing apparatus 1 according to some example embodiments includes a printing device and a cleaning apparatus 100.

The printing device according to some example embodiments includes a base plate 10, a blanket roll 20, a blanket roll supporter 21, a printing plate table 30, a substrate table 40, and a coating apparatus 50. The printing device shown in FIG. 1 and FIG. 2 is an apparatus that may be used in the reverse offset printing process, however the printing device according to some example embodiments is not limited thereto and it may be an apparatus according to various electronic printing methods using the printing plate such as a gravure printing apparatus.

The coating apparatus 50 uniformly coat ink to the blanket roll 20. The ink used to the coating may be a color filter ink of a flat panel display, or a resist ink for forming a pattern. The coating apparatus 50 may include a slit nozzle (not shown) for injecting the ink. The ink coated to the blanket roll 20 is dried for a desired (or alternatively, predetermined) time thereby controlling viscosity thereof.

The blanket roll 20 may be a roll enclosed by a blanket made of a material such as a rubber. After coating the ink on the blanket roll 20, the blanket roll 20 is contacted with the surface of the printing plate C and rotated to form a desired (or alternatively, predetermined) ink pattern on the blanket roll 20, and the blanket roll 20 formed with the ink pattern is contacted with the surface of the substrate B and is rotated to transfer the remaining ink pattern to the substrate B.

The blanket roll supporter 21 is positioned on the base plate 10 and supports the blanket roll 20. The blanket roll supporter 21 may be moved on the base plate 10 thereby moving the blanket roll 20 into the printing plate table 30 or the substrate table 40.

The printing plate table 30 is positioned on the base plate 10 thereby fixing and moving the printing plate C. The printing plate table 30 may be further installed with a chuck plate (not shown) to fix the printing plate C.

The printing plate C may be formed with a convex or concave pattern. When forming the convex pattern, the convex pattern may have an inverse shape of the ink pattern to be transferred to the substrate B. That is, the convex pattern of the printing plate C removes the ink of the contacted portion when being contacted with the blanket roll 20 coated with the ink from the blanket roll 20 such that only the ink to be transferred to the substrate B may remain to the blanket roll 20 as an ink pattern.

The substrate table 40 may fix the substrate B to be formed with the pattern. The ink pattern may be transferred from the blanket roll 20 to the substrate B.

The cleaning apparatus 100 may be positioned on the base plate 10 and the printing plate C may be moved inside the cleaning apparatus 100 to be cleaned.

Next, a printing and cleaning method of the printing apparatus according to some example embodiments will be described with reference to FIG. 1 and FIG. 2.

Firstly, referring to FIG. 1, the ink to be transferred to the substrate B is coated on the blanket roll 20 through the slit nozzle of the coating apparatus 50.

Next, the blanket roll supporter 21 is moved to move the blanket roll 20 to the printing plate table 30.

Next, the blanket roll 20 is contacted with the printing plate C fixed on the printing plate table 30 and is rotated and then the ink contacting the convex portion of the printing plate C is removed to form the ink pattern on the blanket roll 20.

Next, the blanket roll supporter 21 is moved to move the blanket roll 20 formed with the ink pattern to the substrate table 40.

Next, the blanket roll 20 is contacted with the substrate B fixed on the substrate table 40 and is rotated to transfer the ink pattern to the substrate B to form the desired pattern on the substrate B.

Next, referring to FIG. 2, the printing plate C used to the printing process is moved into the cleaning apparatus 100 positioned on the base plate 10 through a driver (not shown) to clean the printing plate C inside the cleaning apparatus 100. Foreign particles such as remaining ink that may remain on the printing plate C is removed through this cleaning process, and may be reused in the following printing process.

Next, a printing plate cleaning apparatus according to some example embodiments will be described with reference to FIG. 3 and FIG. 4.

Figure 3:
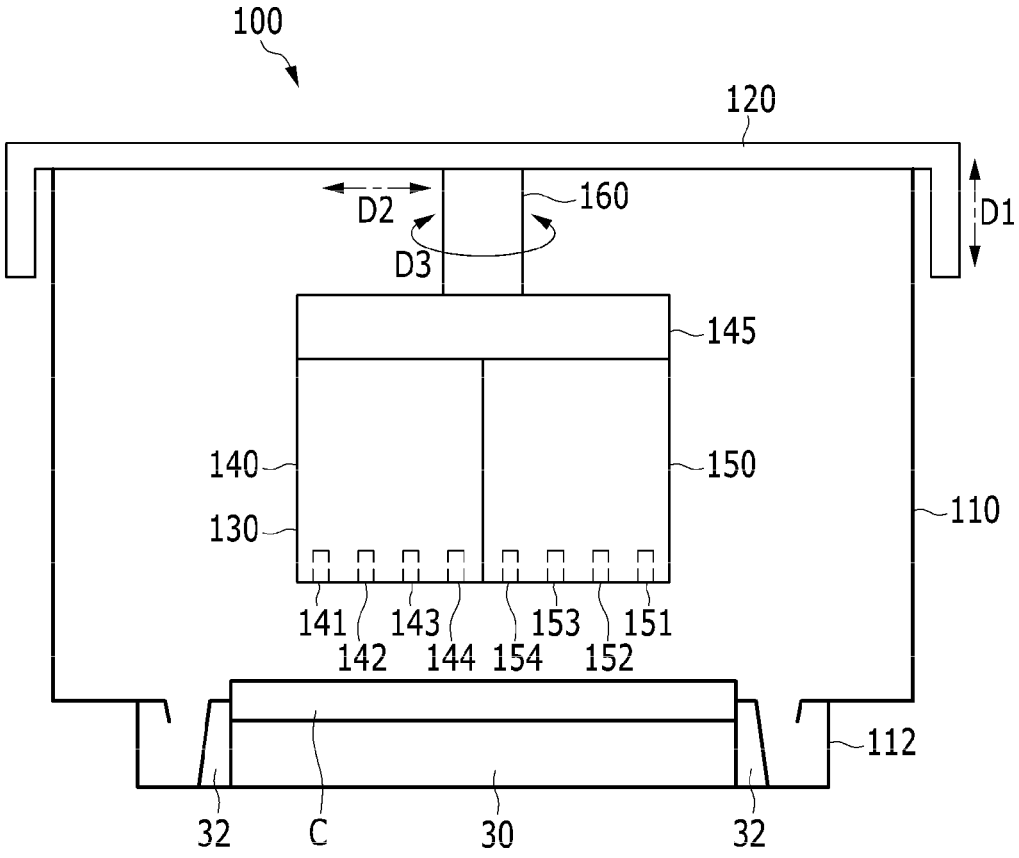
FIG. 3 is a view of a printing plate cleaning apparatus according to some example embodiments.
Figure 4:
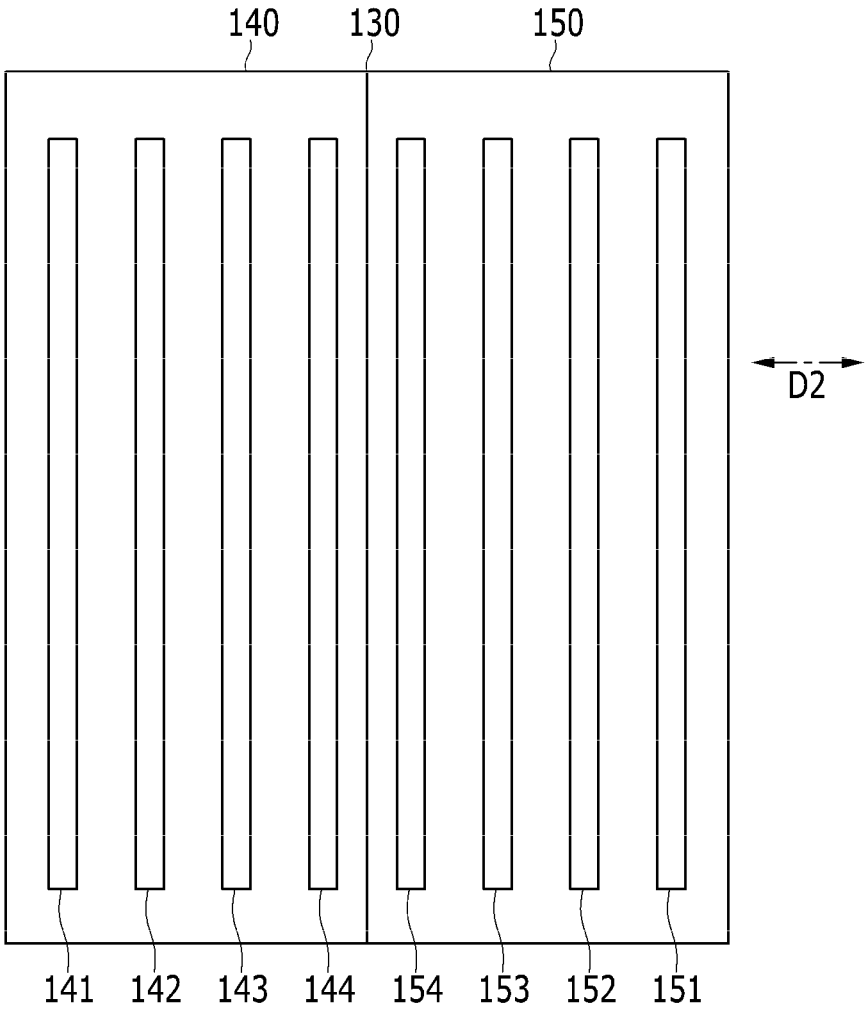
FIG. 4 is a bottom view of a nozzle unit of a printing plate cleaning apparatus according to some example embodiments.

FIG. 3 is a view of a cleaning apparatus according to some example embodiments, and FIG. 4 is a bottom view of a nozzle unit of a cleaning apparatus according to some example embodiments.

Referring to FIG. 3, a cleaning apparatus according to some example embodiments includes a cleaning chamber 110, a chamber holder 120, a nozzle connector 145, a unified nozzle unit 130 that includes a cleaning nozzle unit 140 and a rinsing nozzle unit 150, and a nozzle supporter 160.

The cleaning chamber 110 may prevent waste from being released when processing the cleaning process of the printing plate therein. The cleaning chamber 110 may be installed with an exhaust outlet (not shown) through which organic gas generated in the cleaning process is exhausted.

The cleaning chamber 110 may further include a chamber tray 112 mounting the printing plate table 30 at a lower portion thereof. The chamber tray 112 may be further installed with a discharging unit (not shown) discharging waste such as waste fluid generated in the cleaning work. Particularly, when waste (e.g., waste fluid or waste water that flows down according to a wall surface of the cleaning chamber 110 in the cleaning process of the printing plate) flows to the chamber tray 112, the waste may be discharged through the installed discharging unit.

The chamber holder 120 may fix the cleaning chamber 110 and may be supported by a chamber supporter (not shown) installed on the base plate 10. As shown in FIG. 3, the chamber holder 120 may move the cleaning chamber 110 in the up-and-down direction D1. When moving the cleaning chamber 110 up and down, the chamber holder 120 may be moved up and down with it. As described above, an interval between the unified nozzle unit 130 and the printing plate table 30 may be adjusted by moving the cleaning chamber 110 up and down.

The nozzle supporter 160 may fix the cleaning nozzle unit 140 and the rinsing nozzle unit 150 and may be positioned inside the cleaning chamber 110. As shown in FIG. 3, the nozzle supporter 160 is moved in a horizontal direction D2 to clean the printing plate C while scanning it. As shown in FIG. 3, the nozzle supporter 160 may be attached to the chamber holder 120 so as to rotate in a rotation direction D3 of a clockwise direction or a counterclockwise direction. Also, the nozzle supporter 160 may be operated such that the cleaning nozzle unit 140 and the rinsing nozzle unit 150 may be moved up and down.

The nozzle connector 145 connects the cleaning nozzle unit 140 and the rinsing nozzle unit 150 to the nozzle supporter 160.

The cleaning nozzle unit 140 and the rinsing nozzle unit 150 according to some example embodiments are unified as a single body thereby forming one unified nozzle unit 130, which is fixed to one nozzle supporter 160 through the nozzle connector 145.

Referring to FIG. 3 and FIG. 4, the cleaning nozzle unit 140 may include a cleaner nozzle 143 injecting a cleaner, an air nozzle 142, and suction nozzles 141 and 144 suctioning the waste and the waste fluid generated in the cleaning.

The air nozzle 142 may have a function of injecting air at a high pressure to dry the cleaner or to collect the cleaner on the printing plate C at one side. The air nozzle 142 may be omitted.

One or more suction nozzles 141 and 144 may be provided, and as shown in FIG. 3 and FIG. 4, they may be positioned outside the cleaner nozzle 143.

The position of the nozzles 141-144 may be exchanged.

The rinsing nozzle unit 150 may include a rinsing liquid nozzle 153 injecting the rinsing liquid, an air nozzle 152, and suction nozzles 151 and 154 suctioning waste (e.g., waste fluid or waste water) generated during the cleaning.

The air nozzle 152 may have a function of injecting air at a high pressure to dry the rinsing liquid or to collect the rinsing liquid on the printing plate C at one side. The air nozzle 152 may be omitted.

One or more suction nozzles 141 and 144 may be provided, and as shown in FIG. 3 and FIG. 4, they may be positioned outside the rinsing liquid nozzle 153.

The position of the nozzles 151-154 may be exchanged.

The several nozzles of the unified nozzle unit 130 may be slit-type nozzles, as shown in FIG. 4. As described above, by forming the several nozzles of the unified nozzle unit 130 of the long slit type, a printing plate C of a large area may be cleaned at one time, thereby reducing the cleaning time.

Meanwhile, by rotating the nozzle supporter 160 in the rotation direction D3 shown in FIG. 3, the movement direction of the cleaning nozzle unit 140 and the rinsing nozzle unit 150 may be adjusted. Accordingly, the cleaning direction may be controlled according to the pattern shape of the printing plate C.

As described above, in some example embodiments, the printing plate cleaning apparatus may be positioned on one base plate 10 along with the printing device, however it is not limited thereto, and they may be separately provided.

Meanwhile, a suction bar 32 may be further installed on at least one outer surface of the printing plate table 30 according to some example embodiments. The suction bar 32 may include a suction slit (not shown) for waste (e.g., waste fluid or waste water) generated in the cleaning process of the printing plate and are not suctioned into the nozzle, and overflows outside the printing plate table 30.

Next, referring to FIG. 3 and FIG. 4, a method of cleaning the printing plate by using the cleaning apparatus according to some example embodiments will be described.

Firstly, after the printing process is finished as described above, the printing plate C that is attached on the printing plate table 30 is moved to the cleaning apparatus 100, and then the chamber holder 120 is moved downward such that the cleaning chamber 110 is positioned close to the chamber tray 112.

Next, the nozzle supporter 160 to which the unified nozzle unit 130 is fixed is rotated to adjust the cleaning direction.

Next, the interval between the unified nozzle unit 130 and the printing plate C may be adjusted by moving the nozzle supporter 160 or the chamber holder 120 up and down.

Next, the printing plate C is cleaned by moving the unified nozzle unit 130 in the horizontal direction D2. At this time, the cleaner nozzle 143 of the cleaning nozzle unit 140 injects the cleaner at a high pressure to the printing plate C, and simultaneously the suction nozzles 141 and 144 suction the generated waste (e.g., waste fluid or waste water).

The rinsing nozzle unit 150 may be simultaneously operated with the operation of the cleaning nozzle unit 140 or may be operated sequentially to the cleaning nozzle unit 140. The rinsing liquid nozzle 153 of the rinsing nozzle unit 150 injects the rinsing liquid (e.g., distilled water or deionized water) to the printing plate C, and simultaneously the suction nozzles 151 and 154 suction the generated waste (e.g., waste fluid or waste water).

In this cleaning process of the printing plate, the waste fluid and the remaining water may flow down according to the inner wall surface of the cleaning chamber 110. The flowed waste fluid and remaining water may be discharged outside through a discharging unit installed to the chamber tray 112.

If the cleaning work of the printing plate is completed, the nozzle supporter 160 or the chamber holder 120 is moved to the original position such that the distance from the cleaning chamber 110 to the chamber tray 112 is increased.

The printing plate C that is cleaned may be moved outside the cleaning apparatus 100 in the state that the printing plate C is mounted on the printing plate table 30.

As described above, in the printing apparatus according to some example embodiments, the printing device and the printing plate cleaning apparatus are installed on one base plate and the cleaning nozzle unit 140 and the rinsing nozzle unit 150 that are integrated and fixed inside one cleaning chamber are used for cleaning, such that the entire printing process including the cleaning process and the apparatus thereof may be simplified, the process efficiency may be increased, and the process time may be reduced. Particularly, the cleaning nozzle unit 140 and the rinsing nozzle unit 150 each include a nozzle for injecting the cleaner or the rinsing liquid and a suction nozzle such that the cleaning process is further efficient and the process time may be further reduced. Also, the amount of the required cleaner may be reduced, and the printing plate may be thoroughly cleaned in a short time.

Next, referring to FIG. 5 and FIG. 6, a cleaning apparatus according to some example embodiments will be described. The same constituent elements as in the example embodiment described above use the same reference numerals and the same description is omitted, and hereinafter, differences will be described.

Figure 5:
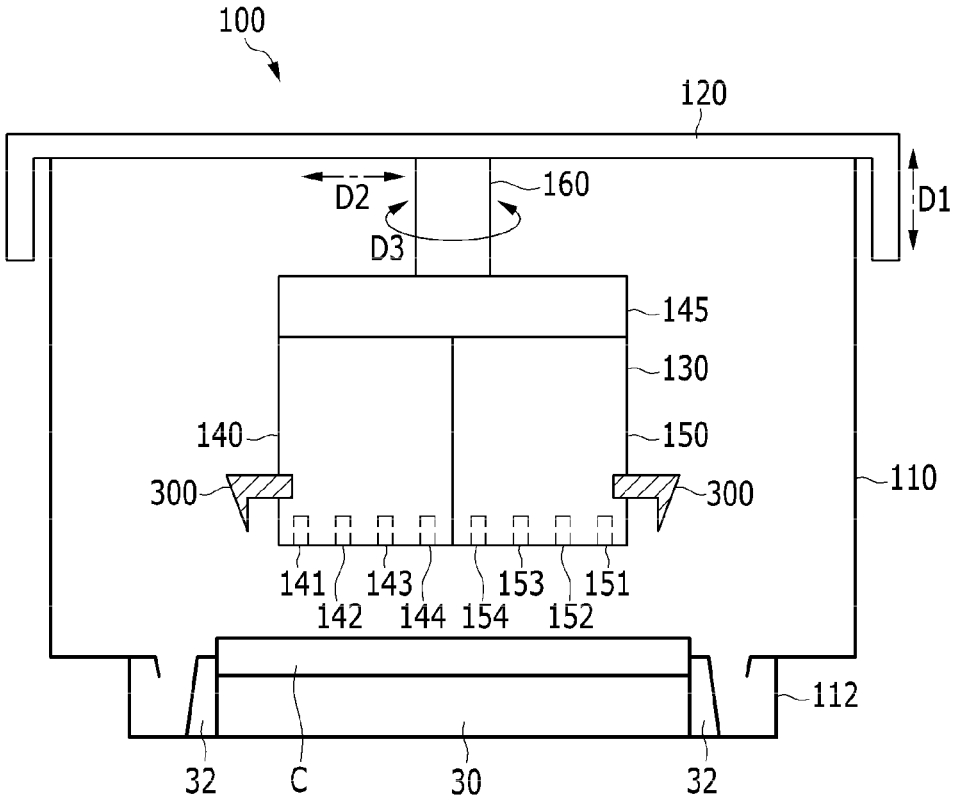
FIG. 5 is a view of a printing plate cleaning apparatus according to some example embodiments.
Figure 6:
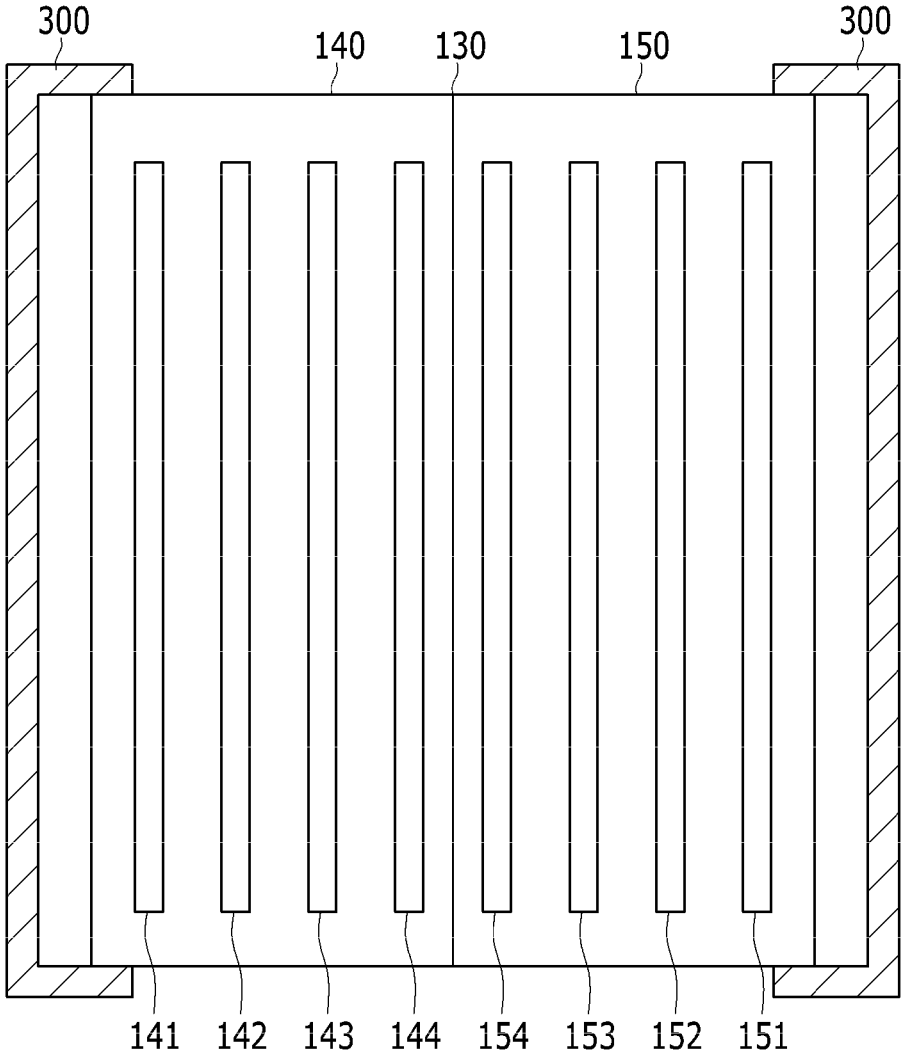
FIG. 6 is a bottom view of a nozzle unit of a printing plate cleaning apparatus according to some example embodiments.

FIG. 5 is a view of a printing plate cleaning apparatus according to some example embodiments, and FIG. 6 is a bottom view of a nozzle unit of a printing plate cleaning apparatus according to some example embodiments.

Referring to FIG. 5 and FIG. 6, a cleaning apparatus according to the present example embodiment is the same as some example embodiments shown in FIG. 3 and FIG. 4, however at least one air knife 300 attached at the outer surface of the unified nozzle unit 130 may be further included.

The air knife 300 injects air at a high pressure at the printing plate C to blow the waste fluid and the remaining water that are not suctioned by the suction nozzles 141, 144, 151, and 154 of the unified nozzle unit 130 and remain after cleaning to collect them at one side of the printing plate table 30, thereby removing them from the printing plate C.

Referring to FIG. 6, the air knife 300 may be formed parallel to the length direction of the nozzles of the unified nozzle unit 130. The injecting angle of the air knife 300 for the unified nozzle unit 130 or the height thereof with regard to the printing plate C may be appropriately adjusted.

Next, the cleaning apparatus according to some example embodiments will be described with reference to FIG. 7 and FIG. 8.

Figure 7:
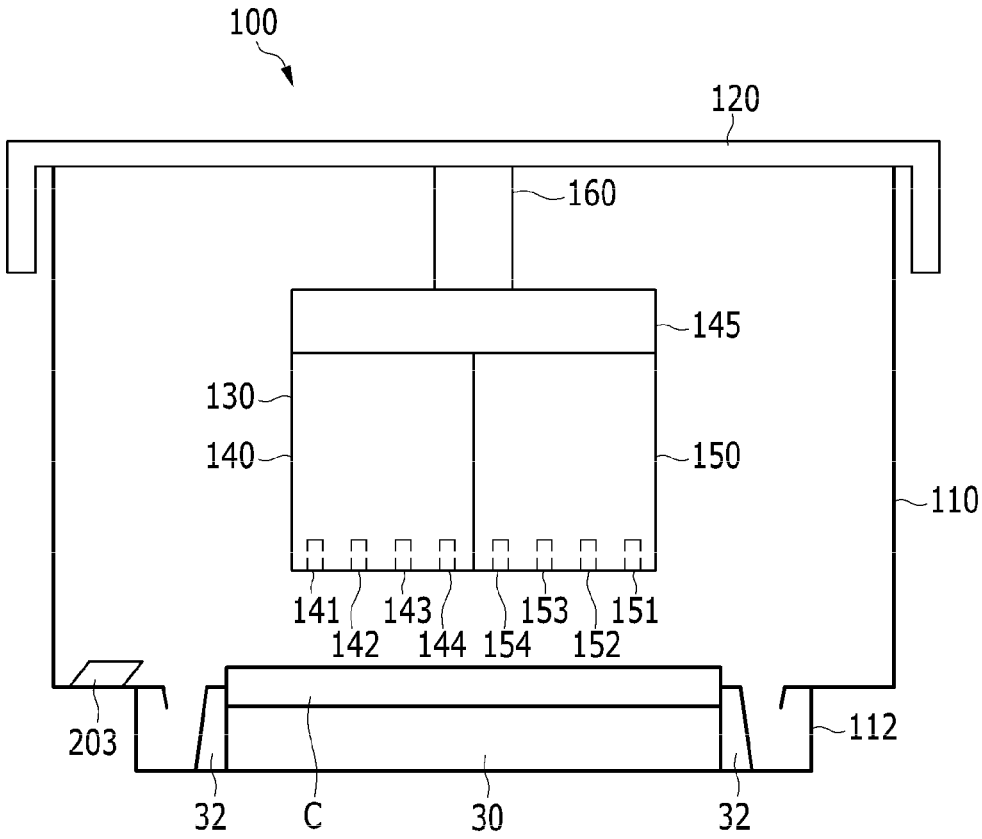
FIG. 7 is a view of a printing plate cleaning apparatus according to some example embodiments.
Figure 8:
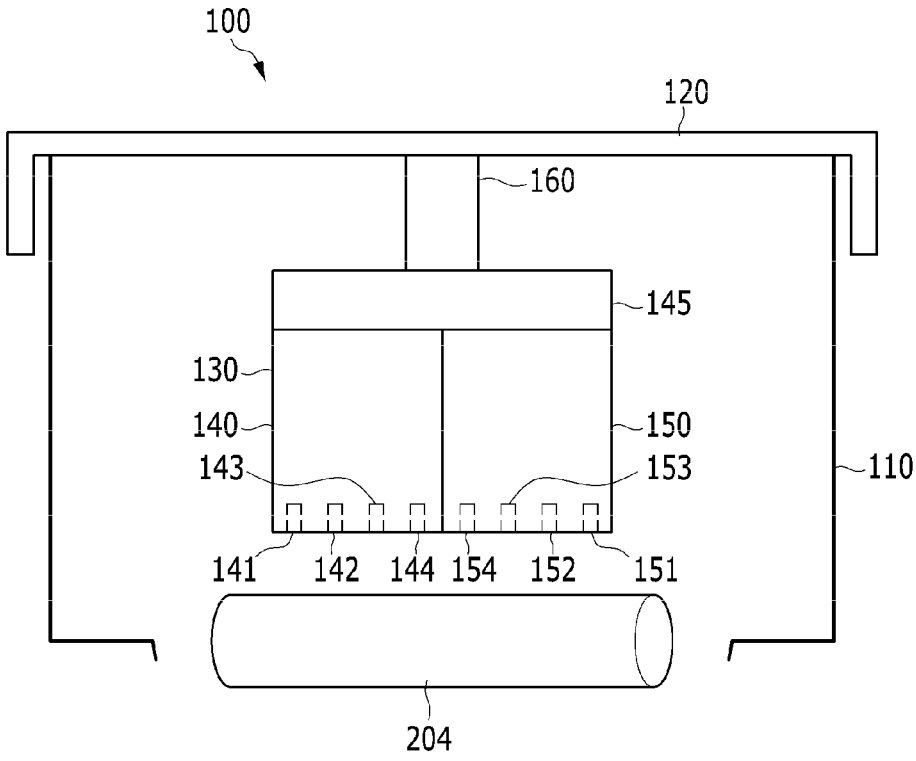
FIG. 8 is a view of a printing plate cleaning apparatus according to some example embodiments.

FIG. 7 is a view of a printing plate cleaning apparatus according to some example embodiments, and FIG. 8 is a view of a printing plate cleaning apparatus according to some example embodiments.

Referring to FIG. 7 and FIG. 8, a printing plate cleaning apparatus according to some example embodiments is the same as most of the cleaning apparatus shown in FIG. 3 to FIG. 6, however a nozzle wiping apparatus to clean the nozzles of the unified nozzle unit 130 is further included.

In the cleaning process of the printing plate C, the waste fluid and the waste water may spatter to the nozzle of the unified nozzle unit 130 such that the nozzle may be plugged in the cleaning after a long time. Accordingly, to prevent blockage of the nozzle, the bottom surface of the unified nozzle unit 130 may be periodically cleaned by using the nozzle wiping apparatus according to some example embodiments.

Firstly, referring to FIG. 7, the nozzle wiping apparatus 203 may be adhered to the lower portion of the cleaning chamber 110. The nozzle wiping apparatus 203 may include a wiper such as a brush that may be attachable and detachable. After finishing the printing plate cleaning, the unified nozzle unit 130 is moved to the nozzle wiping apparatus 203 in the horizontal direction while contacting the wiper, thereby cleaning the bottom portion of the nozzle.

Next, referring to FIG. 8, after the cleaning process is finished, the chamber tray 112 of the lower portion of the cleaning chamber 110 is removed, so the nozzle wiping apparatus 204 may be positioned at the end of the nozzle of the exposed unified nozzle unit 130. The nozzle wiping apparatus 204 according to some example embodiments may be a wiping roll including a sponge or a brush that is capable of easily absorbing the waste fluid and the waste water or removing foreign particles. Although not shown, a moving means for moving the nozzle wiping apparatus 204 in the directions to clean the lower portion of the nozzle of the unified nozzle unit 130 may be further included.

Next, referring to FIG. 9 and FIG. 10, a printing plate table of a printing plate cleaning apparatus according to some example embodiments will be described.

Figure 9:
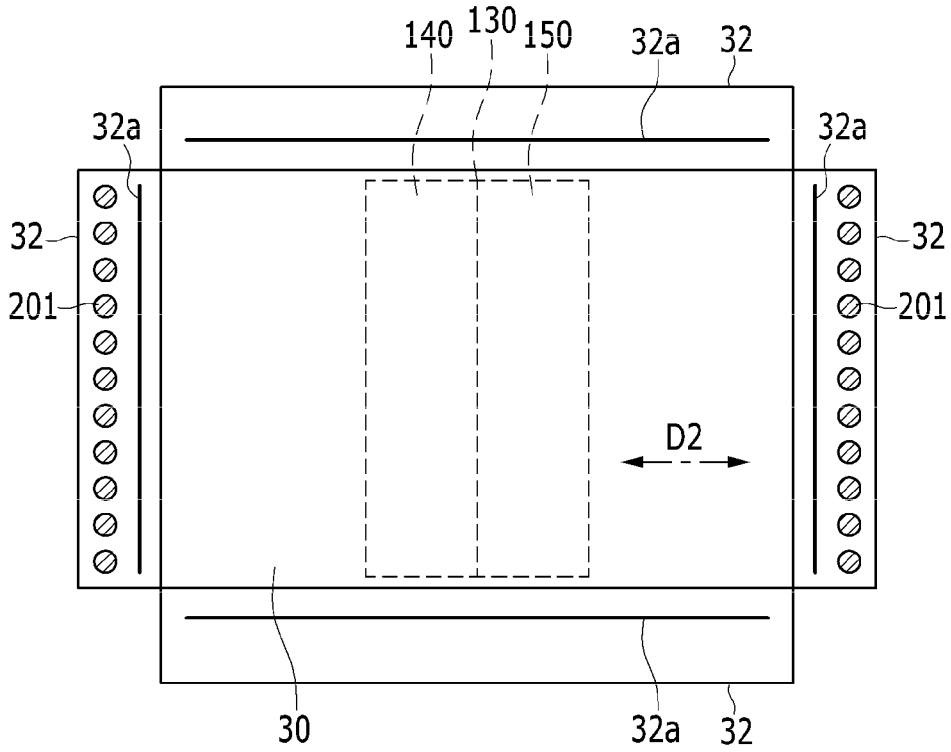
FIG. 9 is a top plan view of a printing plate table according to some example embodiments.
Figure 10:
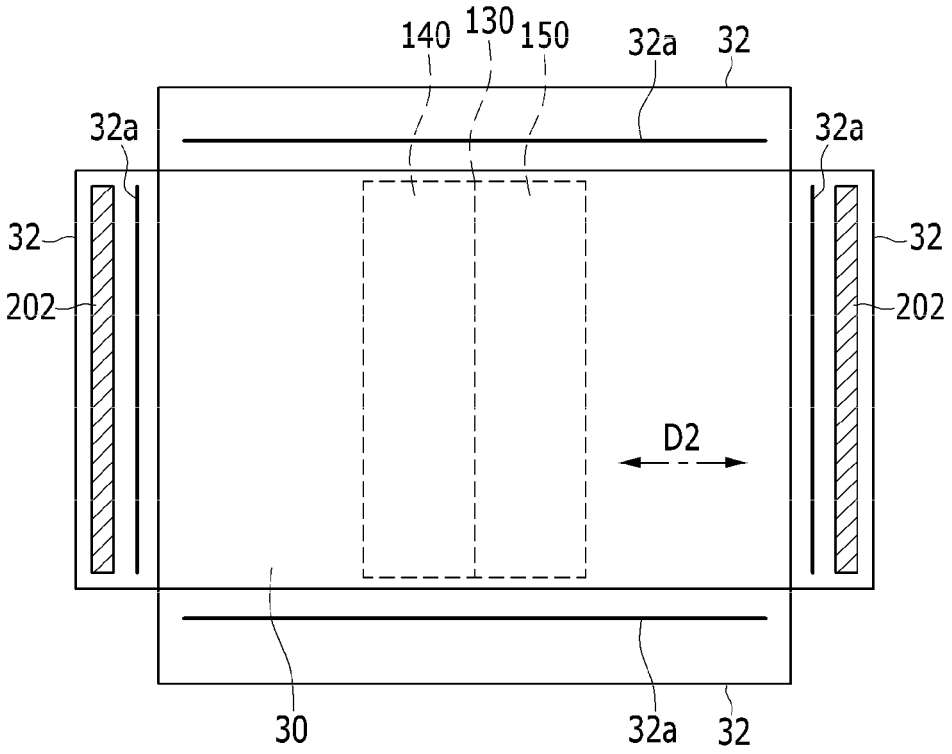
FIG. 10 is a top plan view of a printing plate table according to some example embodiments.

FIG. 9 is a top plan view of a printing plate table according to some example embodiments, and FIG. 10 is a top plan view of a printing plate table according to some example embodiments.

Referring to FIG. 9 and FIG. 10, as described above, a suction bar 32 may be further installed on at least one outer surface of the printing plate table 30. At least one among the suction bar 32 attached to the outer surface of the printing plate table 30 may include a suction slit 32*a* capable of suctioning the waste fluid and the waste water that are generated in the cleaning process of the printing plate and that are not previously suctioned but overflow outside the printing plate table 30.

Also, nozzle wiping apparatus 201 and 202 may be installed at at least one upper surface of the suction bar 32. The nozzle wiping apparatus 201 and 202 according to some example embodiments may include the wiper such as the sponge or the brush. After finishing the printing plate cleaning, the unified nozzle unit 130 is moved to the nozzle wiping apparatus 201 and 202 for the unified nozzle unit 130 to be moved in the horizontal direction D2 while contacting the wiper of the nozzle wiping apparatus 201 and 202, thereby cleaning the lower portion of the nozzle.

As shown in FIG. 9, at least two separate nozzle wiping apparatus 201 may be provided on one suction bar 32, and as shown in FIG. 10, the nozzle wiping apparatus 202 may be formed with a slit shape on one suction bar 32. The shape of the nozzle wiping apparatus 201 and 202 may vary.

Next, a printing plate cleaning apparatus according to some example embodiments will be described with reference to FIG. 11 and FIG. 12.

Figure 11:
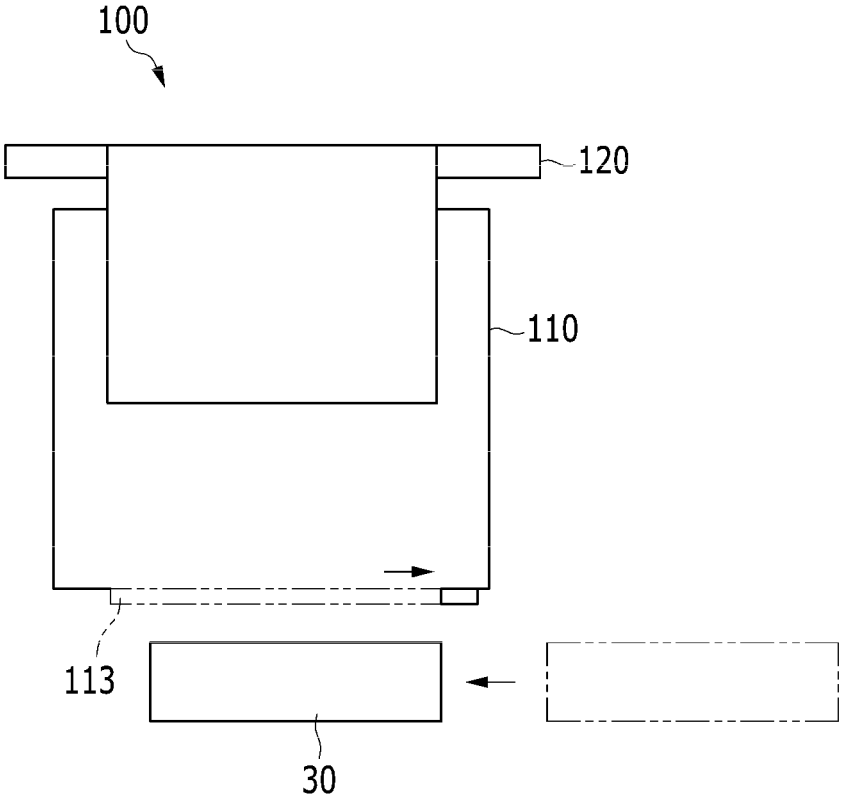
FIG. 11 is a lateral view of a printing plate cleaning apparatus according to some example embodiments.
Figure 12:
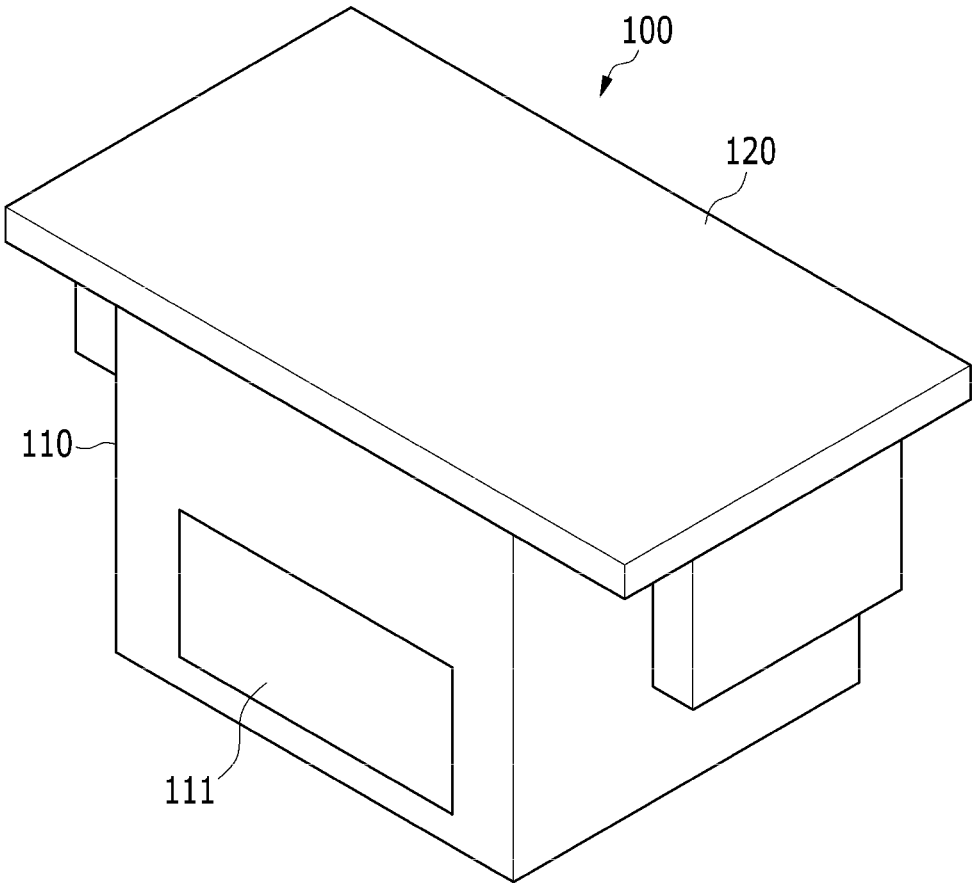
FIG. 12 is a schematic perspective view of a printing plate cleaning apparatus according to some example embodiments.

FIG. 11 is a lateral view of a printing plate cleaning apparatus according to some example embodiments, and FIG. 12 is a schematic perspective view of a printing plate cleaning apparatus according to some example embodiments.

Referring to FIG. 11, a cleaning apparatus according to the present example embodiment is the same as most of the cleaning apparatus 100 of the above example embodiments, however a cleaning chamber cover 113 may be further installed at the lower portion of the cleaning chamber 110. The cleaning chamber cover 113 may prevent the waste remaining in the cleaning chamber 110, or the cleaner or the rinsing liquid formed to the nozzle of the unified nozzle unit 130, from flowing to the base plate 10.

The cleaning chamber cover 113 may be installed as a blind type, as shown in FIG. 11. If the printing plate C to be cleaned is inserted into the cleaning apparatus 100, the cleaning chamber cover 113 is opened such that the cleaning work of the printing plate C may be executed. If the cleaning work of the printing plate C is completed, the cleaning chamber cover 113 is closed such that the waste remained in the cleaning chamber 110 or the cleaner or the rinsing liquid formed at the nozzle may be prevented from flowing into the base plate 10. Differently from FIG. 11, the cleaning chamber cover 113 may be installed as a folding type.

Referring to FIG. 12, a cleaning apparatus according to the present example embodiment is the same as most of the cleaning apparatus 100 of the above example embodiments, however a viewing window 111 may be further installed at the wall surface of the cleaning chamber 110. In the cleaning process of the printing plate, the cleaning stage inside the cleaning chamber 110 may be confirmed through the viewing window 111.

While example embodiments have been particularly shown and described, it will be understood by those of ordinary skill in the art that various changes in form and details may be made therein without departing from the spirit and scope of the present invention as defined by the following claims.

What is claimed is:

1. A printing plate cleaning apparatus, comprising:

a cleaning chamber configured to receive a printing plate to be cleaned;

a nozzle supporter in the cleaning chamber;

a unified nozzle unit that includes a cleaning nozzle unit and a rinsing nozzle unit unified as a body and attached to the nozzle supporter;

a nozzle wiping apparatus configured to clean a nozzle of the unified nozzle unit;

a printing table to which the printing plate is attached; and at least one suction bar attached to at least to at least one outer surface of the printing plate table;

wherein the rinsing nozzle unit includes a cleaner nozzle configured to inject cleaner to the printing plate and a first suction nozzle suctioning waste, wherein the rinsing nozzle unit includes a rinsing liquid nozzle configured to inject rinsing liquid to the printing plate and a second suction nozzle suctioning the waste, and wherein the wiping apparatus includes a second wiper installed on an upper surface of the suction bar.

2. The printing plate cleaning apparatus of claim 1, further comprising:

at least one knife attached to an outer surface of the unified nozzle unit.

3. The printing plate cleaning apparatus of claim 2, wherein at least one of an injecting angle of the at least one air knife and a height of the at least one air knife with regard to the printing plate is adjustable.

4. The printing plate cleaning apparatus of claim 1, wherein the nozzle wiping apparatus includes a first on a lower portion of the cleaning chamber.

5. The printing plate cleaning apparatus of claim 4, wherein the first wiper is attachable to and detachable from portion of the cleaning chamber.

6. The printing plate cleaning apparatus of claim 1, wherein the nozzle wiping apparatus includes a wiper roll that is movable under the nozzle of the unified nozzle unit.

7. The printing plate cleaning apparatus of claim 1, wherein the at least one suction bar includes a suction slit suctioning the waste.

8. The printing plate cleaning apparatus of claim 1, wherein at least one of the cleaning nozzle unit and the rinsing nozzle unit further includes an air nozzle.

* * * * *